US005174479A

United States Patent [19]

Dufour

[11] Patent Number: 5,174,479

[45] Date of Patent: Dec. 29, 1992

[54] METHOD OF FOLDING A SHIRT

[75] Inventor: Claude Dufour, Mönchengladbach, Fed. Rep. of Germany

[73] Assignee: Van Laack Gesellschaft mit Beschrankter Haftung, Monchengladbach, Fed. Rep. of Germany

[21] Appl. No.: 799,821

[22] Filed: Nov. 25, 1991

[30] Foreign Application Priority Data

Nov. 23, 1990 [DE] Fed. Rep. of Germany ..... 4037301

[51] Int. Cl.[5] ..... A41H 33/00; B65D 85/18

[52] U.S. Cl. ..... 223/37; 206/292; 206/296

[58] Field of Search ..... 223/37, 38; 206/299, 206/296, 297, 292

[56] References Cited

U.S. PATENT DOCUMENTS

| | | | |
|---|---|---|---|
| 703,110 | 6/1902 | Beiermeister | 223/37 |
| 2,418,755 | 4/1947 | Campbell | 223/37 |
| 2,615,601 | 10/1952 | Kahn | 206/297 X |
| 3,989,172 | 11/1976 | Wiedmann et al. | 223/37 X |
| 4,134,524 | 1/1979 | Nakano et al. | 223/37 X |
| 4,240,553 | 12/1980 | Leopold | 206/297 X |

FOREIGN PATENT DOCUMENTS

| | | | |
|---|---|---|---|
| 0048773 | 12/1980 | European Pat. Off. . | |
| 1224966 | 2/1960 | France | 206/297 |
| 2282014 | 4/1976 | France | 223/37 |
| 306813 | 4/1955 | Switzerland | 206/296 |

*Primary Examiner*—Werner H. Schroeder
*Assistant Examiner*—Bibhu Mohanty
*Attorney, Agent, or Firm*—Herbert Dubno; Andrew Wilford

[57] ABSTRACT

A shirt having a longitudinally extending body with a front and a back, a collar at a top end of the body, sleeves projecting from sides of the body, and buttons on the front of the body, is folded by first orienting the shirt flat with the body and arms generally coplanar and then folding side parts of the body inward along longitudinal fold lines and folding the sleeves down to lie on the folded-in side parts. Then a bottom part of the body is folded up against the back of the body along a transverse fold line such that a portion of the bottom part projects upward past the collar and some of the front buttons are positioned on the back of the folded-up bottom part. The projecting portion of the bottom part is then tucked between the folded-in side parts and the back of the body to impart to the shirt a generally rectangular shape. The back of the folded shirt is then overlain with a stiffener sheet of generally the same rectangular shape as the folded shirt and at least some of the buttons positioned on the back of the folded bottom part are fitted through the stiffener sheet to secure same in place.

8 Claims, 2 Drawing Sheets

METHOD OF FOLDING A SHIRT

FIELD OF THE INVENTION

The present invention relates to a method of folding a shirt. More particularly this invention concerns such a method which folds the shirt with a stiffener sheet for sale.

BACKGROUND OF THE INVENTION

It is known to fold a shirt having a longitudinally extending body with a front and a back, a collar at a top end of the body, sleeves projecting from sides of the body, and buttons on the front of the body by first orienting the shirt flat on a table with the shirt body and arms generally coplanar. Then side parts of the body are folded inward along longitudinal fold lines and the sleeves are folded down to lie on the folded-in side parts. A bottom part of the body is subsequently folded up against the back of the body along a transverse fold line such that a portion of the bottom part projects upward past the collar and some of the front buttons are positioned on the back side of the folded-up bottom part. The projecting portion of the bottom part is then tucked between the folded-in side parts and the back of the body. Clips or pins may be applied at any stage of this operation to stabilize the folded package thus formed.

European patent No. 48,773 published on Oct. 4, 1984 for R. Hoffman describes such a method where a stiffener sheet, typically of cardboard, is incorporated in the folded shirt to make a stable package. To this end the stiffener has a main panel which is laid atop the shirt before its side parts are folded inward, and an extension of the main panel projects into the collar to stiffen it and fix the position of the stiffener.

When the shirt is made of relatively fine and soft goods it can shift on the cardboard stiffener and become unsightly before it is ever displayed for sale. Furthermore any information about the shirt must be provided on a separate tag or label since the cardboard stiffener is wholly out of sight in the folded-up garment.

OBJECTS OF THE INVENTION

It is therefore an object of the present invention to provide an improved method of folding a shirt for display and sale.

Another object is the provision of such an improved method of folding a shirt for display and sale which overcomes the above-given disadvantages, that is which works even with a shirt of relatively fine goods.

SUMMARY OF THE INVENTION

A shirt having a longitudinally extending body with a front and a back, a collar at a top end of the body, sleeves projecting from sides of the body, and buttons on the front of the body, is folded according to the invention by first orienting the shirt flat with the body and arms generally coplanar and then folding side parts of the body inward along longitudinal fold lines and folding the sleeves down to lie on the folded-in side parts. Then a bottom part of the body is folded up against the back of the body along a transverse fold line such that a portion of the bottom part projects upward past the collar and some of the front buttons are positioned on the back of the folded-up bottom part. The projecting portion of the bottom part is then tucked between the folded-in side parts and the back of the body to impart to the shirt a generally rectangular shape. According to the invention the back of the folded shirt is then overlain with a stiffener sheet of generally the same rectangular shape as the folded shirt and at least some of the buttons positioned on the back of the folded bottom part ar fitted through the stiffener sheet to secure same in place.

Thus with this system the stiffener sheet will constitute the bottom of the package formed by the folded-up shirt. This will make handling and stacking the shirt fairly easy, and allows any product information to be printed on this stiffener sheet whose entire back surface is visible.

According to another feature of this invention the stiffener sheet has an end tab which is fitted between the body and the tucked-in bottom part. This further stabilizes the package.

For extremely soft and hard-to-handle materials the stiffener sheet has an end tab of a transverse width generally equal to the transverse distance between the longitudinal fold lines and a length generally equal to the distance from the transverse fold line to the collar.. This big end tab is first laid on the back of the shirt with edges of the tab lying on the fold lines. Thus the edges of the tab serve to define the fold lines and make folding the shirt fairly simple.

It is also possible according to the invention to fold at least one of the sleeves to the side so that the respective cuff projects laterally past the respective longitudinal fold line. Subsequently the laterally projecting cuff is folded flat against the front of the shirt and secured in place there.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
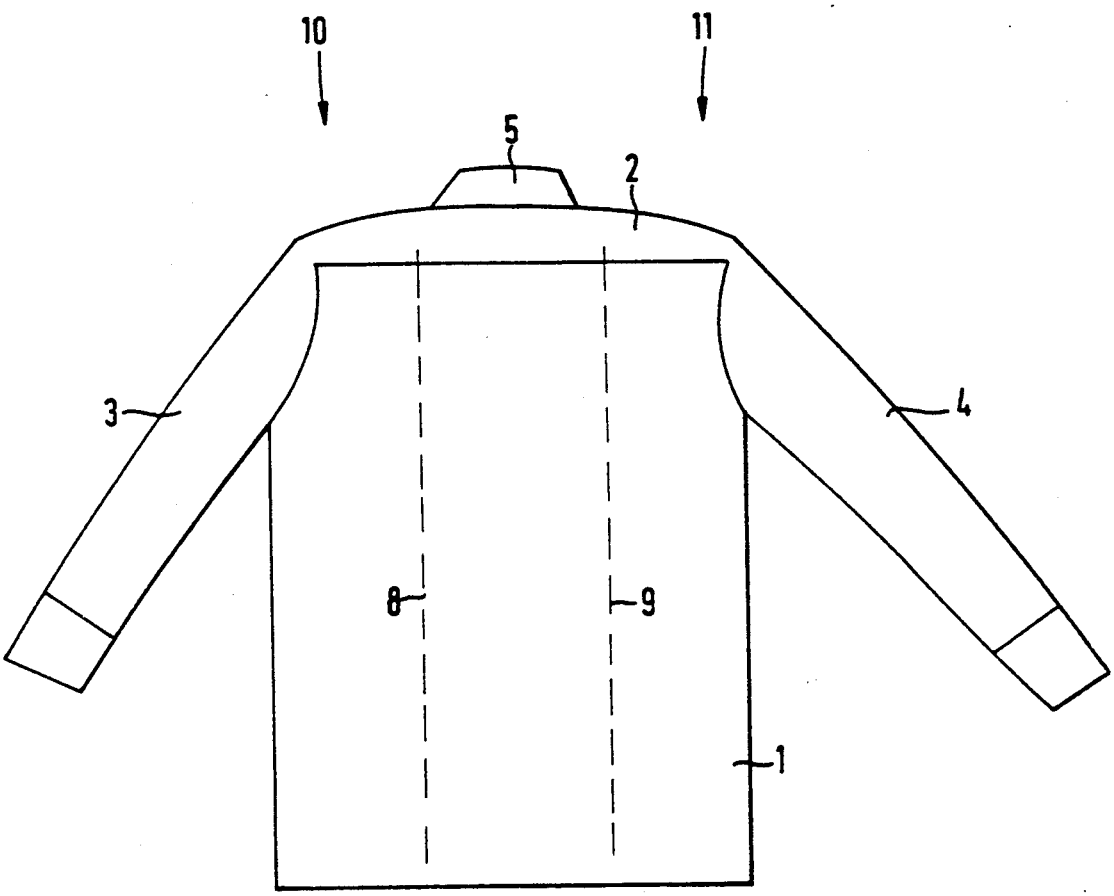
FIG. 1 is a back view of a flattened-out shirt ready for folding according to this invention.
Figure 6:
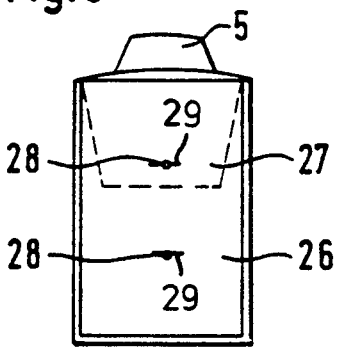
FIG. 6 is a back view illustrating the last step of the method of this invention.

As seen in FIG. 1 a shirt has a body 1, a yoke 2 and collar 5 at its upper end, and two sleeves 3 and 4. To start with the shirt is laid flat on its front side which has buttons 28 (FIG. 6) on a folding machine or table.

Figure 2:
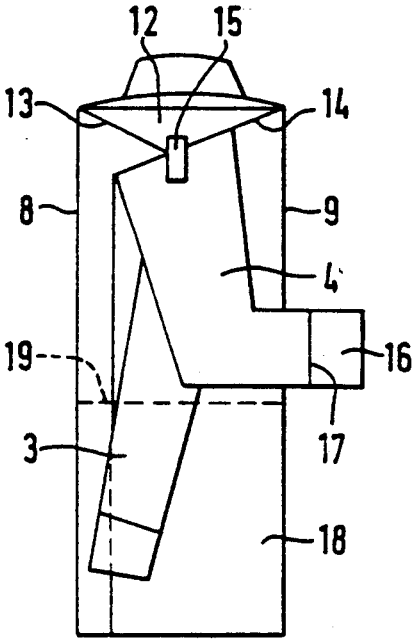
FIGS. 2, 3, and 4 are back views of the shirt during successive steps of the folding operation of this invention.

In a first stage as seen in FIG. 2 two side parts 10 and 11 are folded in along longitudinal fold lines 8 and 9 that roughly divide the body 1 transversely into thirds, and the sleeves 3 and 4 are folded down. Then the cuff 16 of the sleeve 4 is folded out so its seam 17 is past the line 9, and if desired this step can also be done for the other sleeve 3. A clip 15 is fitted over the top of the side parts 10 and 11 whose upper edges 13 and 14 define an upwardly open pocket 12.

Figure 3:
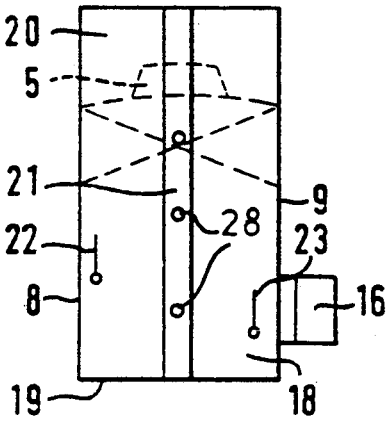

Then as seen in FIG. 3 a bottom part 18 of the body 1 is folded up along a fold line 18 such that a portion 20 of this bottom part 18 projects upward well past the collar 5. This leaves a placket strip 21 and the front buttons 28 exposed on the upwardly facing back of the folded shirt. Pins 22 and 23 may be inserted in the folded garment to stabilize the folds and the position of the sleeve 4 and cuff 16.

Figure 5:
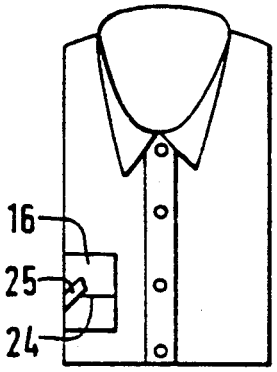
FIG. 5 is a front view of the completely finished shirt.
Figure 4:
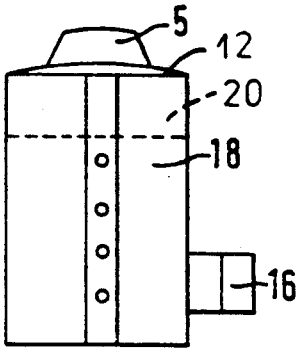

FIG. 4 shows how then the portion 20 is tucked into the pocket 12. The package is turned over as shown in FIG. 5 and the projecting cuff 16 is folded against the front of the garment and secured in place by a clip 25 fitted through the cuff opening 24.

According to the invention a stiffener sheet 26 of rectangular shape with a projecting tab 27 shaped like an isosceles trapezoid is fitted to the package by inserting the tab 27 into the pocket 12 and folding the sheet 26 down over the back of the package. Some of the buttons 28 are fitted through slots 29 to secure the panel 26 in place. This step can be done before or after the step of FIG. 5.

Figure 7:
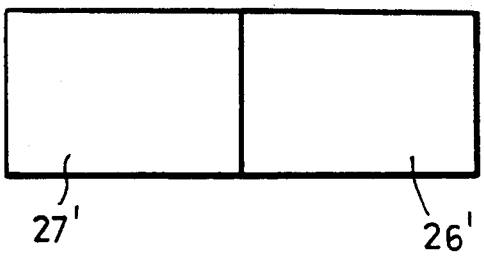
FIG. 7 is a top view of another stiffener according to the invention.

FIG. 7 shows a stiffener panel 26' identical to the panel 26 except that it has a tab 27' whose transverse width corresponds to the transverse distance between the lines 8 and 9 and whose length corresponds to the depth of the pocket 12. This tab 27' is laid on the shirt as shown in FIG. 1 so that the tab edges can define the lines 8, 9, and 19. Such a full-size tab is useful with very hard-to-handle fabrics.

I claim:

1. A method of folding a shirt having a longitudinally extending body with a front and a back, a collar at a top end of the body, sleeves projecting from sides of the body, and buttons on the front of the body, the method comprising the steps of sequentially:

a) orienting the shirt flat with the body and sleeves generally coplanar;

b) folding side parts of the body inward along longitudinal fold lines and folding the sleeves down to lie on the folded-in side parts;

c) folding a bottom part of the body up against the back of the body along a transverse fold line such that a portion of the bottom part projects upward past the collar and some of the front buttons are positioned on the back of the folded-up bottom part;

d) tucking the projecting portion of the bottom part between the folded-in side parts and the back of the body and thereby imparting to the shirt a generally rectangular shape;

e) overlying the back of the folded shirt with a stiffener sheet of generally the same rectangular shape and size as the folded shirt; and f) buttoning at least some of the buttons positioned on the back of the folded bottom part through the stiffener sheet to secure same in place.

2. The shirt-folding method defined in claim 1 wherein the stiffener sheet has an end tab, the method further comprising the step after step d) of:

d') fitting a tab of the stiffener sheet between the body and the tucked-in bottom part.

3. The shirt-folding method defined in claim 1 wherein the stiffener sheet has an end tab of a transverse width generally equal to the transverse distance between the longitudinal fold lines and a length generally equal to the distance from the transverse fold line to the collar, the method further comprising immediately after step a) the step of:

lying the tab on the back of the shirt with edges of the tab lying on the fold lines.

4. The shirt-folding method defined in claim 1, further comprising the step of g) clipping the shirt together.

5. The shirt-folding method defined in claim 1, further comprising the step of g) pinning the shirt together.

6. The shirt-folding method defined in claim 1, further comprising the step after step c) of folding at least one of the sleeves to the side so that the respective cuff projects laterally past the respective longitudinal fold line; and after step d) the step of:

folding the laterally projecting cuff flat against the front of the shirt and securing it there in place.

7. A method of folding a shirt having a longitudinally extending body with a front and a back, a collar at a top end of the body, sleeves projecting from sides of the body, and buttons on the front of the body, the method comprising the steps of sequentially:

a) orienting the shirt flat with the body and sleeves generally coplanar;

b) folding side parts of the body inward along longitudinal fold lines and folding the sleeves down to lie on the folded-in side parts;

c) folding a bottom part of the body up against the back of the body along a transverse fold line such that a portion of the bottom part projects upward past the collar and some of the front buttons are positioned on the back of the folded-up bottom part;

d) clipping together upper edges of the side parts to form an upwardly open pocket between the folded-in side parts and the back of the body;

e) tucking the projecting portion of the bottom part into the pocket and thereby imparting to the shirt a generally rectangular shape;

f) overlying the back of the folded shirt with a stiffener sheet of generally the same rectangular shape and size as the folded shirt; and g) buttoning at least some of the buttons positioned on the back of the folded bottom part through the stiffener sheet to secure same in place.

8. A method of folding a shirt having a longitudinally extending body with a front and a back, a collar at a top end of the body, sleeves projecting from sides of the body, and buttons on the front of the body, the method comprising the steps of sequentially:

a) orienting the shirt flat with the body and sleeves generally coplanar;

b) folding side parts of the body inward along longitudinal fold lines and folding the sleeves down to lie on the folded-in side parts;

c) folding a bottom part of the body up against the back of the body along a transverse fold line such that a portion of the bottom part projects upward past the collar and some of the front buttons are positioned on the back of the folded-up bottom part;

d) tucking the projecting portion of the bottom part between the folded-in side parts and the back of the body and thereby imparting to the shirt a generally rectangular shape;

e) fitting an end tab of a stiffener sheet of generally the same rectangular shape and size as the folded shirt between the body and the tucked-in bottom part;

f) overlying the back of the folded shirt with the stiffener sheet; and g) buttoning at least some of the buttons positioned on the back of the folded bottom part through the stiffener sheet to secure same in place.

* * * * *